US006883249B1

(12) United States Patent
Catlett

(10) Patent No.: US 6,883,249 B1
(45) Date of Patent: Apr. 26, 2005

(54) DRYER WITH INSULATING FLIGHTS

(75) Inventor: Gary Catlett, Louisville, KY (US)

(73) Assignee: Internetek, Inc., Louisville, KY (US)

( * ) Notice: Subject to any disclaimer, the term of this patent is extended or adjusted under 35 U.S.C. 154(b) by 0 days.

(21) Appl. No.: 10/609,048

(22) Filed: Jun. 27, 2003

Related U.S. Application Data

(60) Provisional application No. 60/405,499, filed on Aug. 23, 2002.

(51) Int. Cl.[7] ..... F26B 11/02
(52) U.S. Cl. ..... 34/131; 34/135; 366/25; 432/103
(58) Field of Search ..... 34/68, 131, 135, 34/137; 366/25, 26, 56; 432/103, 105

(56) References Cited

U.S. PATENT DOCUMENTS 1,984,315 A 12/1934 Morris
2,581,756 A 1/1952 Erisman
2,959,869 A 11/1960 Ackerman
3,445,099 A 5/1969 Olsen et al.
3,652,194 A * 3/1972 Bailey ..... 431/9
4,136,965 A 1/1979 Sunnergren et al.
4,193,208 A 3/1980 Ronning
4,293,228 A 10/1981 Swisher, Jr. et al.
4,439,040 A 3/1984 Mendenhall
4,447,205 A * 5/1984 Smith ..... 431/328
5,295,821 A * 3/1994 Daukss ..... 432/103
5,515,620 A 5/1996 Butler
5,664,882 A 9/1997 Green et al.

* cited by examiner

*Primary Examiner*—Stephen Gravini
(74) *Attorney, Agent, or Firm*—Camoriano and Associates; Theresa Fritz Camoriano

(57) ABSTRACT

An insulating flight for a dryer incorporates inner and outer plates with insulation between them. The concave surfaces of the inner and outer plates provide a space for the insulation and allow for thermal expansion without stressing the welds between the inner and outer plates.

9 Claims, 4 Drawing Sheets

DRYER WITH INSULATING FLIGHTS

BACKGROUND OF THE INVENTION

This application claims priority from provisional application Ser. No. 60/405,499 filed Aug. 23, 2002.

The present invention relates to dryers for heating and drying aggregate or soil, and, in particular, to special insulating flights for lining the combustion area of the dryers.

SUMMARY OF THE INVENTION

The present invention improves over the prior art combustion flights by providing combustion flights that are insulated. This protects the shell structure and saves energy.

DESCRIPTION OF THE PREFERRED EMBODIMENT

Figure 1:
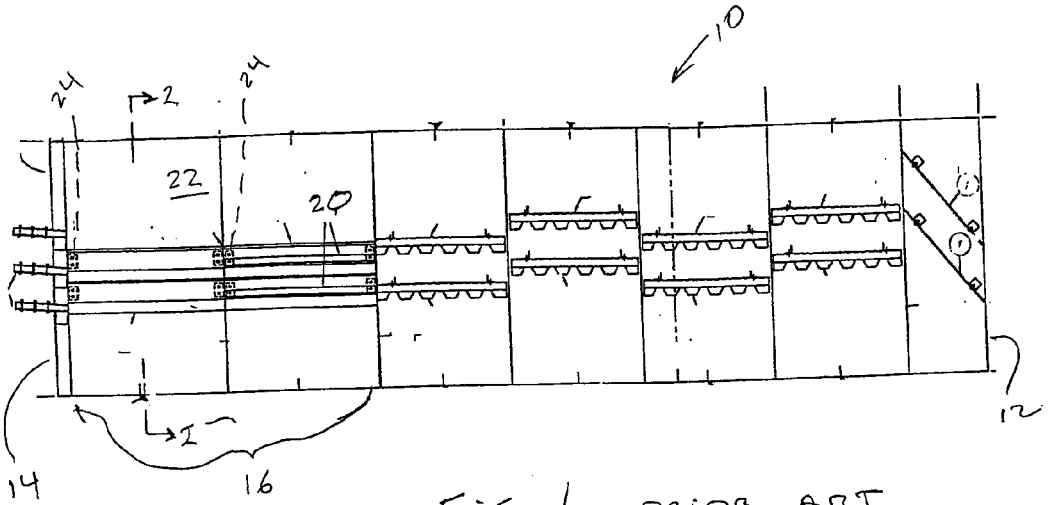
FIG 1 PRIOR ART
FIG. 1 is sectional view of a typical prior art dryer with only some of the flights shown for clarity.
Figure 2:
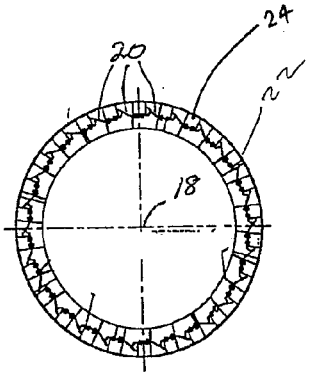
FIG 2 PRIOR ART
FIG. 2 is a view along line 2—2 of FIG. 1.

FIG. 1 shows a typical prior art dryer 10. The material to be heated enters the dryer 10 on the right end 12 and leaves on the left end 14. The burner is located on the left end 14. In the left-most section 16 of the dryer 10, for about 6–12 feet, are combustion flights 20, the end views of which are shown in FIG. 2. These flights are convex on their inner surfaces, facing toward the axis 18 of the dryer 10, and they are concave on their outer surfaces, facing toward the dryer shell 22. The flights 20 overlap each other to provide a kind of lining for the dryer 10, protecting the dryer shell 22 from the direct heat of the burner. The flights 20 are secured to the dryer 10 by being bolted onto L-shaped clips 24, which are welded to the dryer shell 22.

Figure 3:
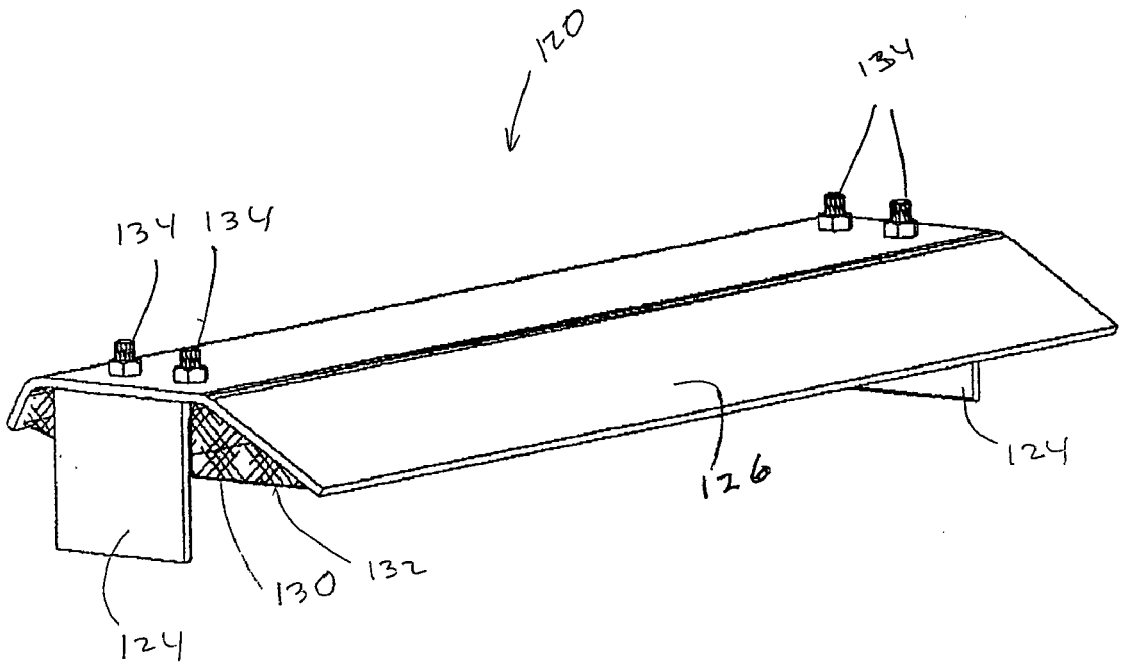
FIG. 3 is a perspective view of an insulating flight made in accordance with the present invention.

FIGS. 3–8 depict insulating flights 120 made in accordance with the present invention. FIG. 3 is a perspective view of one of these insulating flights 120 which may be designed to be a direct replacement for the combustion flights 20 found in the prior art. The insulating flights 120 include a thick, convex inner metal plate 126 but, on the concave outer surface 128 (See FIG. 5) of the inner plate 126 is a sheet 130 of two-inch thick ceramic fiber insulation (similar to fiberglass batting used to insulate buildings, but made with ceramic fibers that can withstand higher temperatures than can fiberglass). The sheets 130 that have been used include Premier Brand ceramic fiber blankets, which are rated either at 1,900° F. or 2,400° F., but it is understood that other insulating materials and other thicknesses may be used without departing from the scope of this invention.

On the outside of the ceramic fiber insulation 130 is an outer metal plate 132, which is convex toward the dryer shell 22 and concave toward the axis 18 of the dryer. The outer metal plate 132 preferably is made of a thinner gauge material than the inner plate 126 and is tack welded to the inner plate along its edge, forming a hollow compartment between the inner and outer plates 126, 132, which houses the ceramic fiber insulation 130. Thus, a type of sandwich is formed, with inner and outer plates 126, 132, and with ceramic fiber insulation 130 between the plates 126, 132. These insulating flights 120 are then bolted to L-shaped clips 124 (see FIGS. 3 and 4) by means of bolts 134, and the clips 124 are welded to the inside of the drier shell 22 in the same manner as were the uninsulated flights 20 of the prior art.

Figure 6:
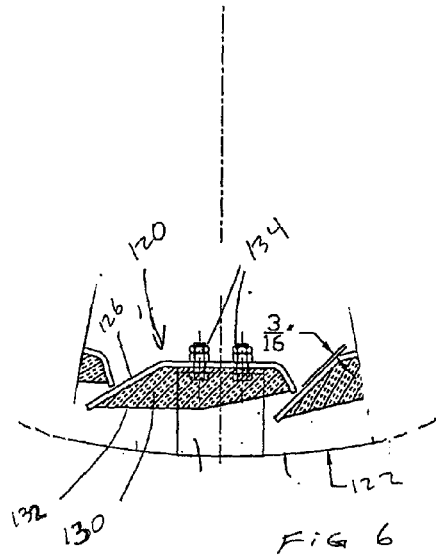
FIGS. 6–8 are broken away, sectional views showing the insulated flights of FIG. 3 mounted on various diameters of dryer shells, showing that the amount of overlap may vary slightly, depending upon the diameter of the shell.
Figure 7:
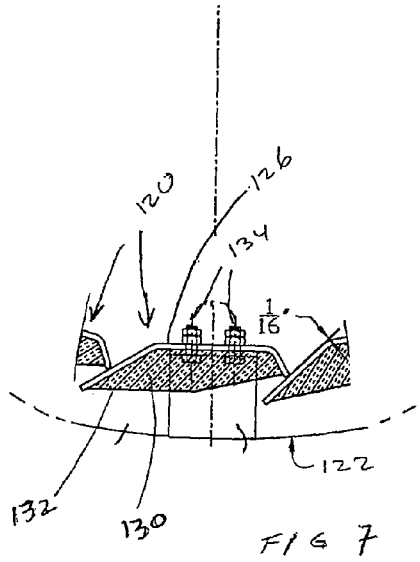
Figure 8:
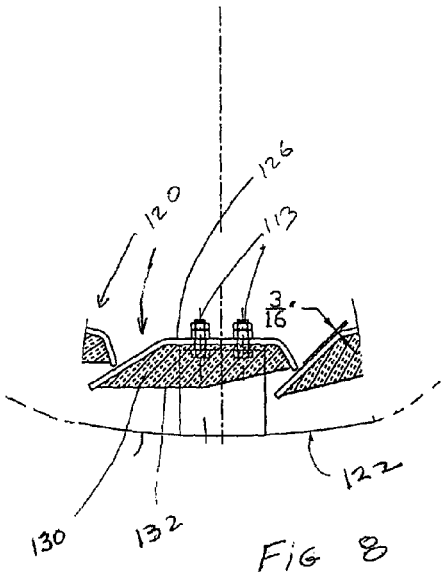

FIGS. 6, 7, and 8 show the insulating flights 120 mounted on various diameters of dryer shells 122, showing that the amount of overlap may vary slightly, depending upon the diameter of the shell 122.

Figure 4:
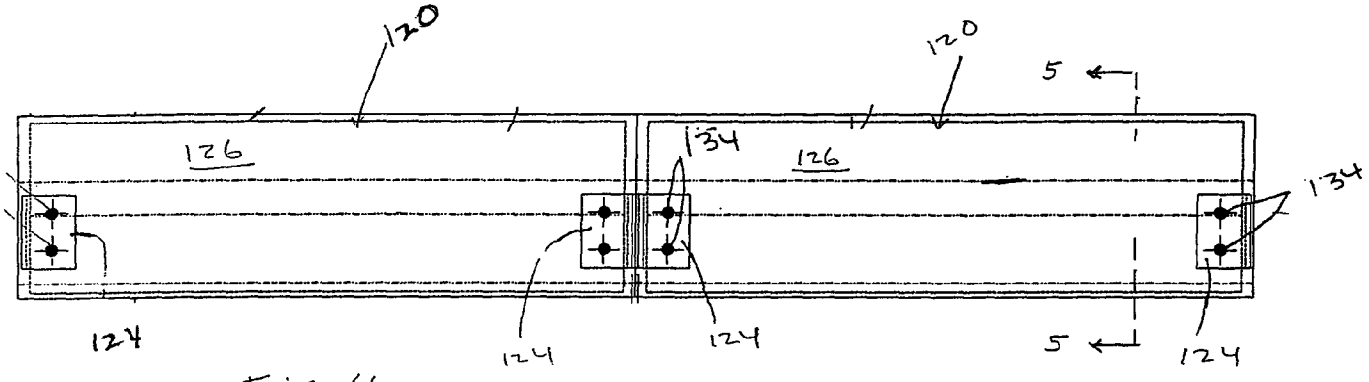
FIG. 4 is a plan view of two side-by-side insulating flights of the type shown in FIG. 3, as they would typically be mounted inside a dryer.
Figure 5:
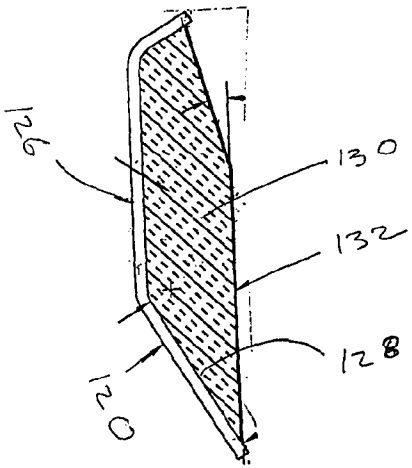
FIG. 5 is a view along line 5—5 of FIG. 4.

FIG. 4 is taken from inside the dryer looking outwardly. It shows the innermost surface 126 of the insulated flights 120 as well as the L-shaped clips 124 and the bolts 134 that secure the flights 120 to the clips 124. The outer edge of each clip 124 is welded to the inner surface of the shell 122.

When the burner is fired up, the inner plates 126 of the insulating flights 120 will heat up and expand. The convex shape of the outer metal plate 132 permits it to straighten out as the inner plate 126 expands, without stressing the welds between the inner and outer plates 126, 132. The ceramic fiber insulation 130 also flexes to accommodate expansion and contraction of the plates 126, 132.

A prior art dryer 10, as shown in FIG. 1, may be converted to an insulated dryer by replacing the old, uninsulated flights 20 with the new, insulating flights 120. The conversion simply requires unbolting the old flights 20 and bolting in the new flights 120. The result is a dryer 10 that can operate at higher temperatures without harming the shell 22 and that can operate more efficiently, with less wasted energy. Also, since the insulated flights 120 prevent the shell 22 from getting so hot, this design creates a better work environment for anyone who works around the dryer 10.

It will be obvious to those skilled in the art that modifications may be made to the embodiment described above without departing from the scope of the present invention.

What is claimed is:

1. A dryer, comprising:

a cylindrical shell defining first and second ends, an interior, an exterior, and a longitudinal axis;

a burner located at the first end of the shell;

a plurality of flights secured to the interior of the shell and overlapping each other, each of said flights including an inner metal plate defining an inner surface that is convex toward the longitudinal axis of the shell and an outer surface that is concave toward the shell; and insulation between said inner metal plate and said shell.

2. A dryer as recited in claim 1, wherein said insulation is flexible insulation.

3. A dryer as recited in claim 2, wherein said insulation is made from ceramic fibers.

4. A dryer as recited in claim 1, and further comprising an outer metal plate, which is convex toward the drier shell and concave toward the axis of the shell, wherein said insulation is sandwiched between said inner and outer metal plates.

5. A dryer as recited in claim 4, wherein said insulation is made of ceramic fibers.

6. A combustion flight for a dryer, comprising:

an inner metal flight shell having a convex inner surface and a concave outer surface;

an outer metal flight shell having a convex outer surface and a concave inner surface, said inner and outer metal flight shells being secured together with their concave surfaces facing each other to form a hollow compartment; and insulation located in said hollow compartment between said inner and outer metal flight shells.

7. A combustion flight for a dryer as recited in claim 6, wherein said insulation is made of fibers.

8. A combustion flight for a dryer as recited in claim 7, wherein said insulation is made of ceramic fibers.

9. A combustion flight for a dryer as recited in claim 6, and further comprising clips bolted to said flight for securing said flight to the shell of the dryer.

* * * * *